US006095172A

United States Patent [19]

Trapp et al.

[11] Patent Number: 6,095,172

[45] Date of Patent: Aug. 1, 2000

[54] SUNSHADE FOR OUTDOOR FURNITURE

[76] Inventors: Carl P. Trapp; Brenda M. Trapp, both of 1990 NW. 10th St., Delray Beach, Fla. 33445

[21] Appl. No.: 09/215,767

[22] Filed: Dec. 18, 1998

[51] Int. Cl.[7] ..... E04H 15/02; A47C 7/66

[52] U.S. Cl. ..... 135/96; 135/128; 135/132; 135/133; 135/143; 135/161; 297/184.11; 297/184.17

[58] Field of Search ..... 135/96, 161, 128, 135/132, 133, 143; 297/184.1, 184.11, 184.15, 184.17

[56] References Cited

U.S. PATENT DOCUMENTS

| | | | |
|---|---|---|---|
| 4,683,900 | 8/1987 | Carmichael | 135/133 X |
| 5,096,257 | 3/1992 | Clark | 135/96 X |
| 5,551,745 | 9/1996 | Huang | 297/184.17 X |
| 5,609,177 | 3/1997 | Iver | 135/133 X |
| 5,833,310 | 11/1998 | Labelle | 135/96 X |
| 5,921,258 | 7/1999 | Francois | 297/184.17 X |

*Primary Examiner*—Robert Canfield
*Attorney, Agent, or Firm*—Robert M. Downey, P.A.

[57] ABSTRACT

A sunshade assembly removably mounts to outdoor furniture, such as a lounge chair, and includes a canopy structure having first and second pivotally movable frame members, and a foldable material canopy fitted to and extending between the frame members. A tensioning bar removably secures to the respective frame members at opposite ends to maintain the frame members separated so that the canopy is pulled taut, thereby blocking the sun's rays and creating an area of shade. A telescoping support arm attaches to the furniture at one end and to the first frame member at an opposite end and is adjustable in length to selectively position and maintain the expanded canopy throughout a range of adjusted positions relative to the furniture, thereby controlling the location of the created area of shade. The canopy structure collapses behind the furniture upon removing the tensioning bar and releasing the lower end of the support arm from attachment with the furniture. Movable flags are provided for signalling for waiter service and for indicating that the furniture is occupied.

19 Claims, 8 Drawing Sheets

SUNSHADE FOR OUTDOOR FURNITURE

BACKGROUND OF THE INVENTION

1. Field of the Invention

The present invention relates to sunshade devices and, more particularly, to a sunshade assembly specifically structured for removable attachment to outdoor furniture (e.g., lounge chairs), wherein the sunshade assembly is fully collapsible and further includes means for adjustably positioning the canopy relative to the furniture and the user, to thereby control the location of areas of shade and thus, the amount of sun protection.

2. Description of the Related Art

Most people enjoy relaxing at the beach, in their yard, or beside a swimming pool. In particular, vacationers at hotels and resorts spend a considerable amount of their leisure time sunbathing in lounge chairs while reading, socializing, watching their children swim, or just simply relaxing. Notwithstanding, people having varying degrees of tolerance to the sun's potentially harmful rays, and some individuals prefer to avoid direct sunlight altogether, even though they enjoy the outdoors. The threat of skin cancer and premature aging of the skin is particularly worrisome to a large percentage of the population. And because the face, neck and arms are exposed to the sun virtually every day, and certainly more frequently than other areas of the body, many sunbathers try to protect their facial skin while lying in the sun by placing a towel or washcloth over their face. While this helps to reduce sun exposure and potential skin damage (e.g., wrinkles, age spots, skin cancer), the use of a towel to cover areas of the body is generally awkward and many times uncomfortable. For instance, when covering the face, a person is unable to see, making it difficult to socialize or enjoy the surroundings. More importantly, covering one's face is particularly a problem for parents who need to be watching their children, especially if their children are swimming. Furthermore, it can be extremely uncomfortable to be covered with a towel in the higher temperatures normally experienced while sunbathing.

Over the years, various devices and assemblies have been developed for providing shade to sunbathers. Most notably, umbrellas are still widely used by beachgoers, homeowners, and commercial establishments such as restaurants, hotels and resorts, to provide protection and comfort from the sun's intense rays. Others have proposed various canopy and sunshade structures which mount to outdoor chairs. For example, many resorts provide lounge chairs with cabana style canopies that have a semi-dome configuration extending up from the back of the chair and surrounding the back rest and the sides, top and rear of the chair. While this type of structure can be somewhat effective in providing shade, many people find these style chairs to be confining, as they restrict visibility and impede one's ability to communicate and socialize with others around them. Moreover, cabana style canopies on lounge chair create poor ventilation, due to the enclosing structure which inhibits cross ventilation. Furthermore, canopy-style cabanas usually need to be permanently mounted to specific style chairs, and thus they are not readily adapted for retrofitting to a variety of lounge chair designs.

The various sunshade devices known in the art, including those discussed above, have further drawbacks and limitations which limits their effectiveness, particularly at commercial locations (e.g., hotels and resorts). Specifically, the various sunshade devices in the art, including umbrellas and cabana canopies, have limited adjustment ability for repositioning the sunshade device relative to the user and any attached furniture. This lack of adjustability makes it extremely difficult to control the location of areas of shade in order to protect select portions of one's body. More specifically, the sunshade devices in the related art fail to provide for a full range of adjustability from full body sun to full body shade (full body protection from the sun). Moreover, the sunshade devices presently being used in the art have structures which impede the ability to stack the attached furniture, such as lounge chairs. This is particularly a problem with resorts, wherein it is desirous to stack lounge chairs at the end of each day so that the surrounding pool area can be cleaned.

In view of the foregoing, there remains a definite need in the art for a fully collapsible sunshade assembly which removably attaches to an article of furniture (e.g., an outdoor lounge chair), and wherein the sunshade assembly can be fully collapsed, while attached to the furniture, without impeding stacking of the furniture. There is a further need for a sunshade assembly which provides a means for adjusting the canopy through a range of operable positions to selectively control locations of areas of shade, thereby offering a full range of sun protection, from full body sun to full body shade.

SUMMARY OF THE INVENTION

The present invention is directed to a sunshade assembly which removably mounts to outdoor furniture, such as a lounge chair, and includes a canopy structure having first and second pivotally movable frame members, and a foldable material canopy fitted to and extending between the frame members. A tensioning bar removably secures to the respective frame members at opposite ends to maintain the frame members separated so that the canopy is pulled taut, thereby blocking the sun's rays and creating an area of shade. A telescoping support arm attaches to the furniture at one end and to the first frame member at an opposite end. The support arm is adjustable in length to selectively position and maintain the expanded canopy throughout a range of adjusted positions relative to the furniture, thereby controlling the location of the created area of shade. The canopy structure collapses behind the furniture upon removing the tensioning bar and releasing the lower end of the support arm from attachment with the furniture. Movable flags are provided for signalling for service, such as cocktail service, and for indicating that the furniture is occupied.

In general, it is a primary object of the present invention to provide a fully collapsible sunshade assembly which removably attaches to outdoor furniture, wherein the sunshade assembly can be collapsed, while remaining attached to the furniture without impeding the ability to stack the articles of furniture.

More specifically, it is a primary object of the present invention to provide a fully collapsible sunshade assembly for removable attachment to lounge chairs, which fully collapses while remaining attached to the lounge chair, thereby permitting a plurality of lounge chairs to be stacked in their normal fashion.

It is a further object of the present invention to provide a sunshade assembly, as described above, which is aerodynamic in design.

It is a further object of the present invention to provide a sunshade assembly, as described above, which offers an infinite range of shade adjustments from full body shade to full body sun exposure.

It is yet a further object of the present invention to provide a sunshade assembly, as described above, which is readily adaptable to a wide range of outdoor furniture designs.

It is still a further object of the present invention to provide a sunshade assembly, as described above, which allows for attachment of accessory devices, such as drink flags and beverage cradles.

It is still a further object of the present invention to provide a sunshade assembly, as described above, which allows for quick disassembly and mounting to outdoor furniture.

It is still a further object of the present invention to provide a sunshade assembly, as described above, which is constructed of a lightweight, high strength material and design.

It is yet a further object of the present invention to provide a sunshade assembly, as described above, which includes a canopy which is structured and configured to create maximum shade while also not impeding cross ventilation.

It is yet a further object of the present invention to provide a sunshade assembly, as described above, which does not interfere with the ability of adjacent users, sitting in lounge chairs (or other outdoor furniture) to communicate with one another.

It is still a further object of the present invention to provide a sunshade assembly, as described above, which uses a lounge chair as a foundation to support the unit, thereby providing greater stability, particularly under windy conditions.

These and other objects and advantages of the present invention will be more readily apparent with reference to the detailed description and accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Referring to FIGS. 1–5, the sunshade apparatus of the present invention is shown and generally indicated as 10. The apparatus 10 includes a collapsible canopy assembly 12 which mounts to a conventional article of outdoor furniture 14, such as a lounge chair. As seen in the several views of the drawings, the apparatus 10 mounts at various locations to the frame structure of the lounge chair, as described more fully hereinafter. An advantageous feature of the present invention is the ability to mount the apparatus 10 to a wide variety of outdoor furniture designs of different manufacturers. While it is generally intended that the sunshade apparatus remain attached to the furniture 14, once mounted thereto, it can be easily removed if desired.

Figure 6A:
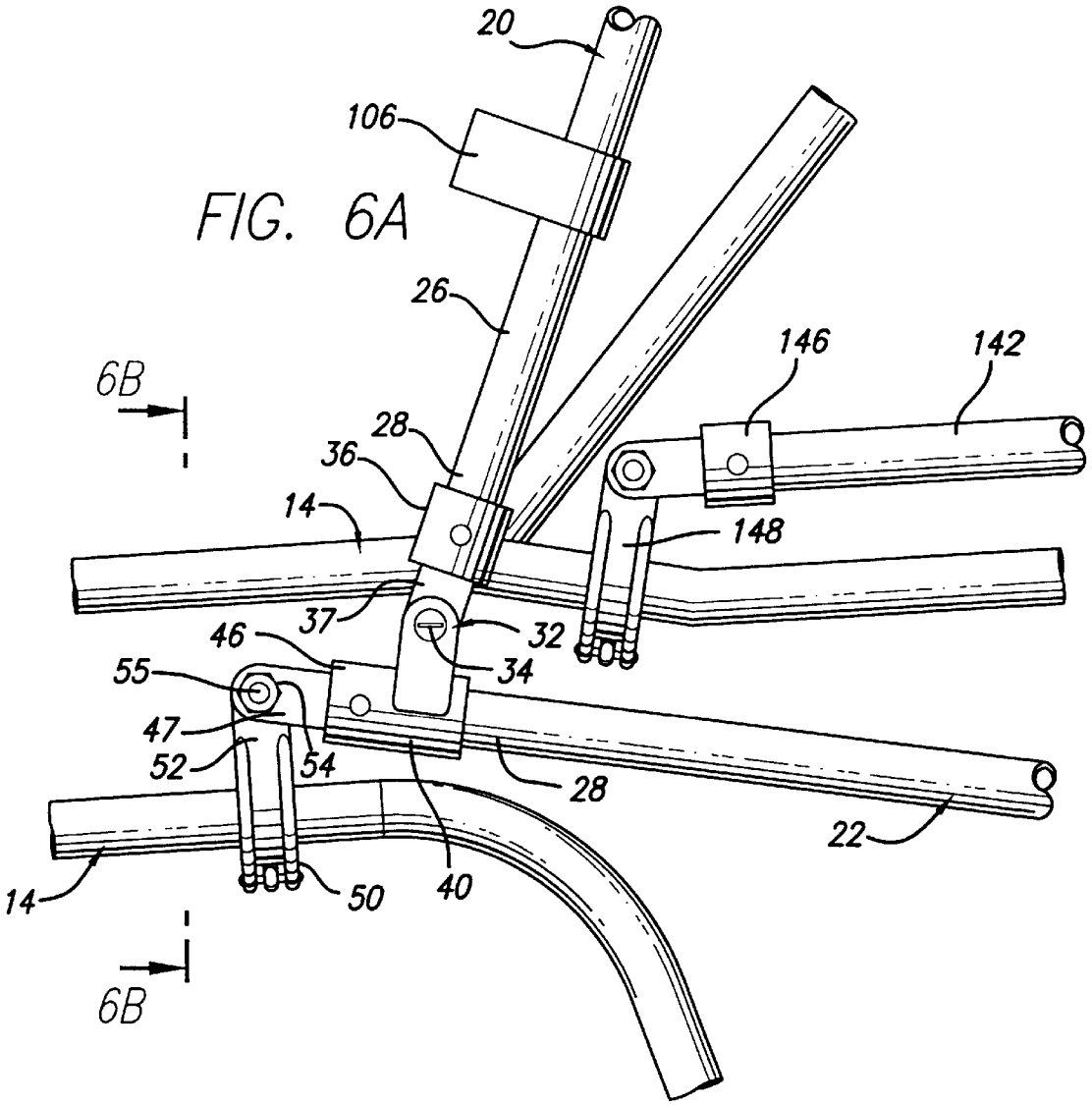
FIG. 6A is an isolated view taken from the area indicated as 6A in FIG. 1.
Figure 6B:
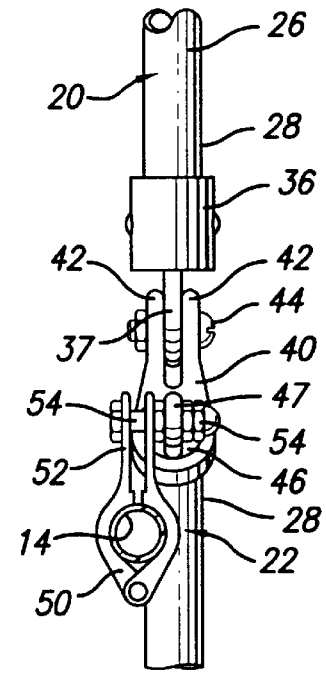
FIG. 6B is an isolated view taken along the plane of the line 6B—6B in FIG. 6A.
Figure 8A:
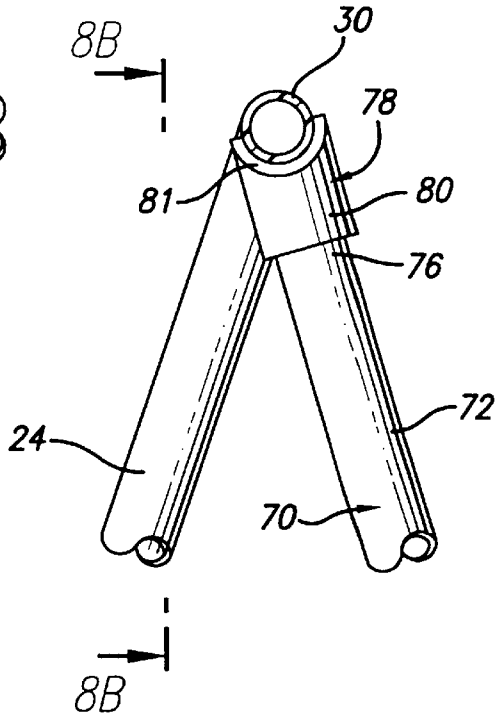
FIG. 8A is an isolated view taken along the plane of the line 8A—8A in FIG. 4.
Figure 8B:
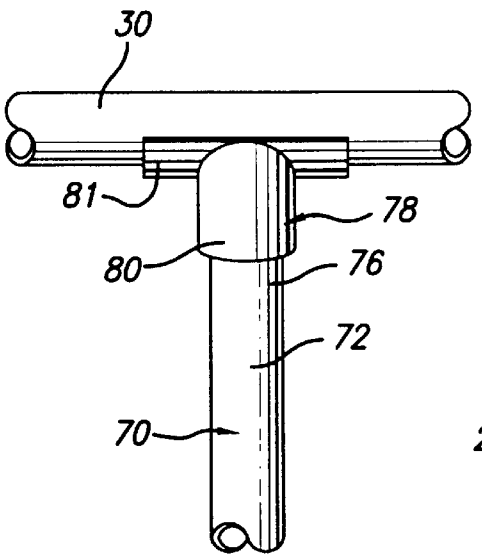
FIG. 8B is an isolated view taken along the plane of the line 8B—8B in FIG. 8A.

The canopy assembly 12 includes a pair of generally U-shaped frame members including a forward U-shaped frame member 20 and a rear U-shaped frame member 22. Each of the frame members 20, 22 includes opposite legs 24, 26 terminating at distal ends 28. The U-shaped frame members 20, 22 further include a cross arm 30 extending generally perpendicularly between the opposite legs 24, 26 defining a base of the inverted U-shape. Referring to FIG. 6A, the distal ends 28 of each of the legs of the U-shaped frame member are fitted with hardware to facilitate pivotal attachment to one another and further to provide for mounting of the canopy assembly 12 to the furniture article 14. Specifically, hinge means 32 are provided for pivotal attachment of the legs 24 and the legs 26 of the forward and rear frame members. This permits pivotal movement of the forward and rear frame members about a pivotal axis 34. In particular, the distal ends 28 on the legs 24, 26 of the forward frame member 20 are fitted with an end eye fitting 36 having a central flange 37 extending from an end thereof, in longitudinal alignment with the legs 24, 26. The hinge means 32 further include a clevis fitting 40 attached to the distal ends 28 of the legs of the rear frame member 22. The clevis 40 includes a pair of spaced flanges 42 which receive the central flange 37 of the end eye 36 therebetween, as best seen in FIG. 6B. Apertures formed through the flanges 37 and 42 aligned with one another when the end eye mates with the clevis, allowing axial receipt of a bolt, screw or like fastening element 44 therethrough, thereby providing a pivotal attachment about pivotal axis 34. The distal ends 28 on the legs of the rear frame member 22 are further fitted with end eye fittings 46 having a flanged member 47 extending therefrom. A clamp member 50, such as a pipe clamp, is fitted to the frame structure of the furniture article 14 and includes a mounting flange 52 extending therefrom. The mounting flange 52 includes apertures formed therethrough for axial alignment with an aperture in the flange member 47 on the end eye 46. A bolt 54 or like element is fitted therethrough to facilitate pivotal attachment of the canopy assembly 12 to the frame structure of the furniture article 14, as best seen in FIGS. 6A and 6B.

The canopy assembly 12 further includes a canopy panel 60 formed of a lightweight, foldable material which is specifically adapted to block sun light and to produce an area of shade protection. In the preferred embodiment, the canopy panel 60 is manufactured of a waterproof, fade resistant material sold in the industry under the trademark SUNBRELLA. As shown throughout the several views of the drawings, the canopy panel 60 is preferably of a generally rectangular configuration and includes a forward edge zone 62, a rear edge zone 64, and opposite edge zones 66, 68 extending along the opposite sides of the panel 60 from the forward edge zone 60 to the rear edge zone 64. The forward edge zone 62 is fitted to the cross arm 30 of the forward frame member 20 and the rear edge zone 64 is fitted to the cross arm 30 of the rear frame member 22. The fitting of the forward and rear edge zones 62, 64 to the cross arms 30 may be accomplished by wrapping the flexible material panel 60 about the respective cross arms 30 and stitching along a seam to effectively secure the forward and rear edge zones along the length of the respective cross arms 30.

Figure 5:
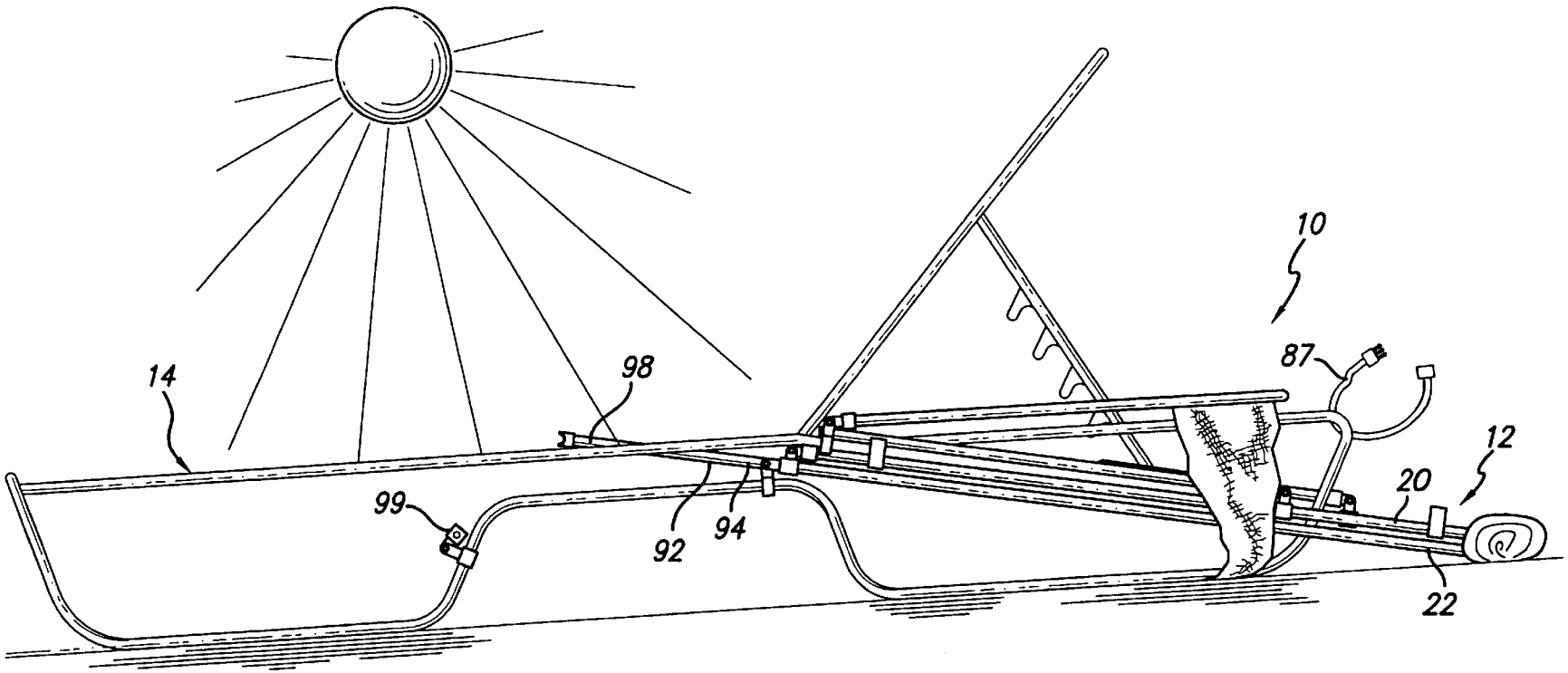
FIG. 5 is a front elevation showing the sunshade assembly attached to the lounge chair and disposed in a collapsed position, to thereby permit stacking of the lounge chairs.

As described above, the forward and rear frame members 20, 22 are pivotally attached by hinge means 32 and are thus pivotally movable relative to one another about a pivotal axis 34. Specifically, the forward and rear frame members are pivotally movable relative to one another between a collapsed, stacked position, as best seen in FIG. 5, and an open, operable position, as seen in FIGS. 1–4. In the collapsed position, the legs 24, 26 of the forward and rear frame members 20, 22 are disposed in parallel, adjacent relation, as the cross arms 30 of the respective forward and rear frame members 20, 22 are brought together in close, adjacent relation. The open, operable position is defined by the legs of the forward frame member being disposed in angular relation to the legs of the rear frame member 22, with the cross arms 30 of the respective forward and rear members 20, 22 disposed in spaced, separated relation. Separation of the cross arms of the respective frame members is limited by the canopy panel, which is pulled taut to define the fully open, operable position, preventing further separation of the frame members.

Brace means 70 are provided to maintain the canopy assembly 12 in the fully open, operable position. Specifically, the brace means 70 include an elongate tensioning bar 72 having a central zone 74 and opposite ends 76. Each of the opposite ends 76 is fitted with a saddle clamp 78 having a generally T-shaped configuration including a cylindrical base 80. The base 80 is specifically sized for receipt of the distal end 76 of the tensioning bar therein to attach the saddle clamp to the tensioning bar. The saddle clamps 78 further include a semi-cylindrical member 81 extending generally perpendicular to the cylindrical base member 80 and defining a cradle sized and configured for releasable attachment partially about the exterior circumference of the cross arms 30 of each of the forward and rear frame members 20, 22. It is important that the tensioning bar 72 be formed of a substantially rigid, yet flexible material so that the central zone 74 can be flexed to assume a bowed configuration, as seen in FIGS. 1–4. In a preferred embodiment, the tensioning bar 72 is formed of polyvinyl chloride (PVC). When applying a bending force to the central zone 74, to cause the tensioning bar 72 to bow, the opposite ends 76, including the saddle clamps 78 thereon, are brought closer together, to thereby reduce the straight line distance between the saddle clamps, allowing insertion and removal of the tensioning bar between the cross arms. The tensioning bar 72 has a flexible memory which causes the tensioning bar to return to a normally relaxed, straight position, upon removing the bending force. The flexible memory of the tensioning bar results in the saddle clamps 78 exerting an outward force on the respective cross arms 30 with the tensioning bar in the bowed position, thereby maintaining the frame members 20, 22 in the fully open, operable position with the canopy panel pulled taut.

To attach the tensioning bar, the tensioning bar is grasped near the opposite ends 76 and a bending force is applied to cause the tensioning bar to bow. With the tensioning bar maintained in the bowed position, the tensioning bar is positioned below the canopy panel, with the saddle clamps 78 positioned adjacent the respective cross arms 30. It is important to first open the canopy assembly to the operable position, with the cross arms of the forward and rear frame members fully separated. The tensioning bar must be bowed sufficiently so that the distance between the saddle clamps 78 on the opposite ends of the tensioning bar 72 is slightly less than the distance between the respective cross arms on the forward and rear frame members. Upon placing the cradle members 81 of the saddle clamps 78 in alignment for receipt of the respective cross arms 30 therein, the external bending force is released so that the tensioning bar 72 seeks to return to the relaxed, straight position. Upon moving towards the straight position, the cradles 81 of the saddle clamps engage the respective cross arms and apply an outward pressure thereto, causing the forward and rear frame members to be separated until the canopy panel is pulled taut and further separation of the frame members is prevented. When fitted to the frame members, the tensioning bar 72 remains slightly bowed, as seen in FIGS. 1–4, to maintain outward, separating pressure to the respective forward and rear frame members. To remove the tensioning bar, the tensioning bar is again grasped near the opposite ends and a bending force is applied to reduce the overall distance between the saddle clamps 78, thereby releasing them from grasping engagement with the respective cross arms. The tensioning bar can then be removed and the forward frame member can be collapsed against the rear frame member as the canopy panel collapses, as seen in FIG. 5.

As discussed above, the canopy assembly 12 is pivotally mounted to the frame structure of the furniture article (e.g., lounge chair) by means of a pair of end eye fittings 46, on each of the ends of the legs of the rear frame member, and clamps 50 fitted to opposite sides of the furniture article. Through bolts 54, pivotally attaching the canopy assembly 12 to the clamps 50, define a pivotal axis 55 about which the entire canopy assembly is movable relative to the furniture article 14. In this manner, the entire canopy assembly 12 can be collapsed and lowered to a position wherein the canopy panel and cross arms 30 are positioned behind the back rest 15 of the furniture 14, when the canopy assembly 12 is not being used, as seen in FIG. 5. A support strap 87 may be fitted about the collapsed canopy panel and cross arms 30 and to the back frame structure of the furniture article 14 to suspend the canopy assembly above the ground surface. In this position, a plurality of the furniture articles, such as lounge chairs, can be stacked without causing interference with the canopy assembly.

The pivotal mounting of the canopy assembly 12 to the furniture article 14 further provides for adjustable positioning of the canopy assembly 12 when in the open, operable position. In this manner, areas of shade created by the open canopy panel can be adjustably positioned relative to the furniture article 14 and a person sitting on the furniture. Thus, depending upon the angle of the sun, and the desired amount of shade, the canopy assembly can be selectively adjusted throughout the course of the day. In particular, the canopy assembly 12 can be adjusted to create an area of shade which substantially covers the entire seating area of the furniture article 14, so that a person sitting on the furniture is completely protected from the sun. Alternatively, the canopy assembly 12 can be adjusted to provide sun protection to partially shade the seating area, thereby providing sun protection to selected areas of the body, such as the face and shoulders, while permitting other areas of the body to be exposed to the sun. The canopy assembly 12 may further be adjusted to provide full sun exposure to the seating area, so that a person seated on the furniture article may sun their entire body.

Figure 1:
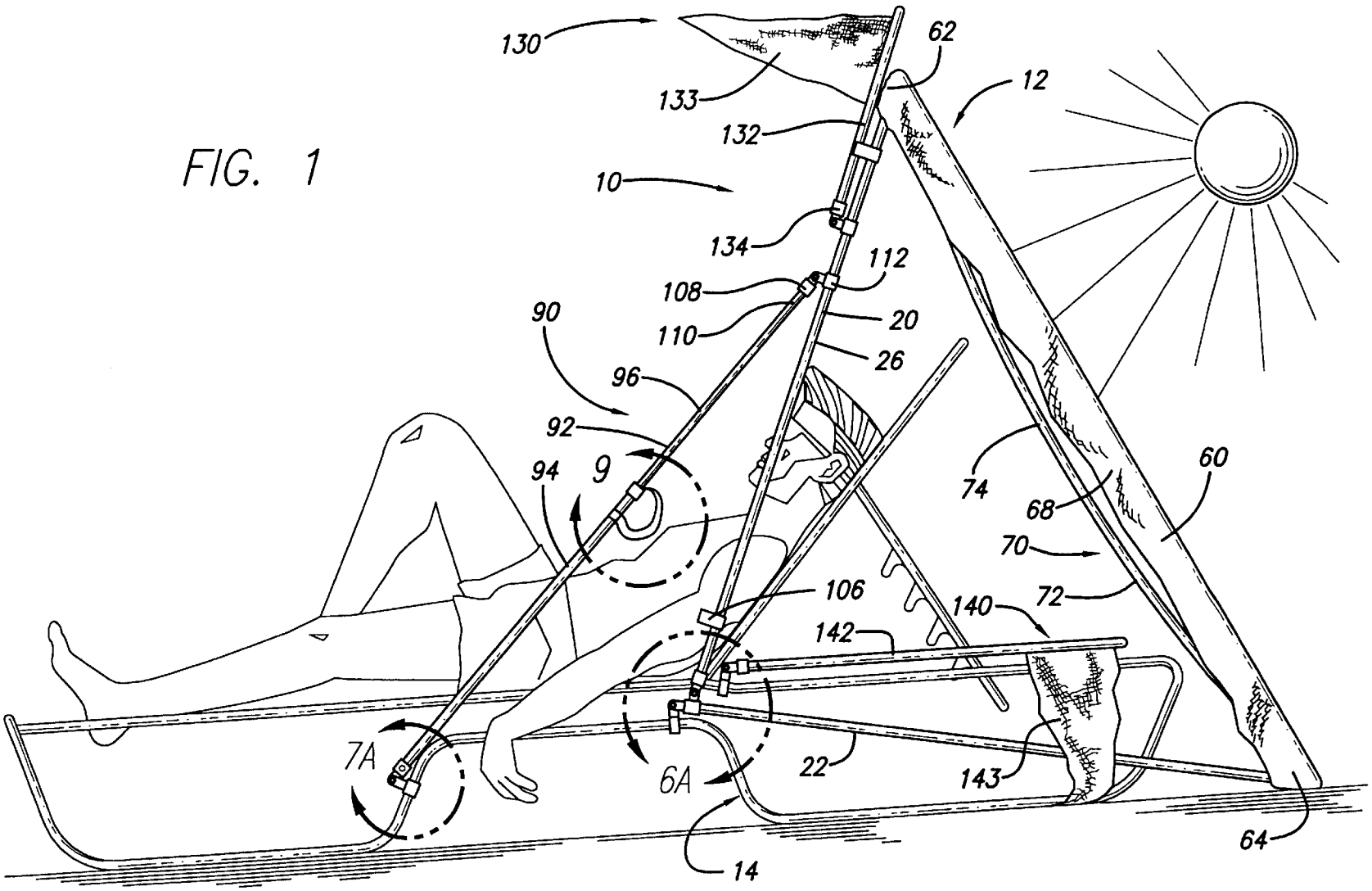
FIG. 1 is a side elevation showing the sunshade assembly of the present invention installed to a lounge chair and operably supported in one selected, adjusted position.
Figure 2:
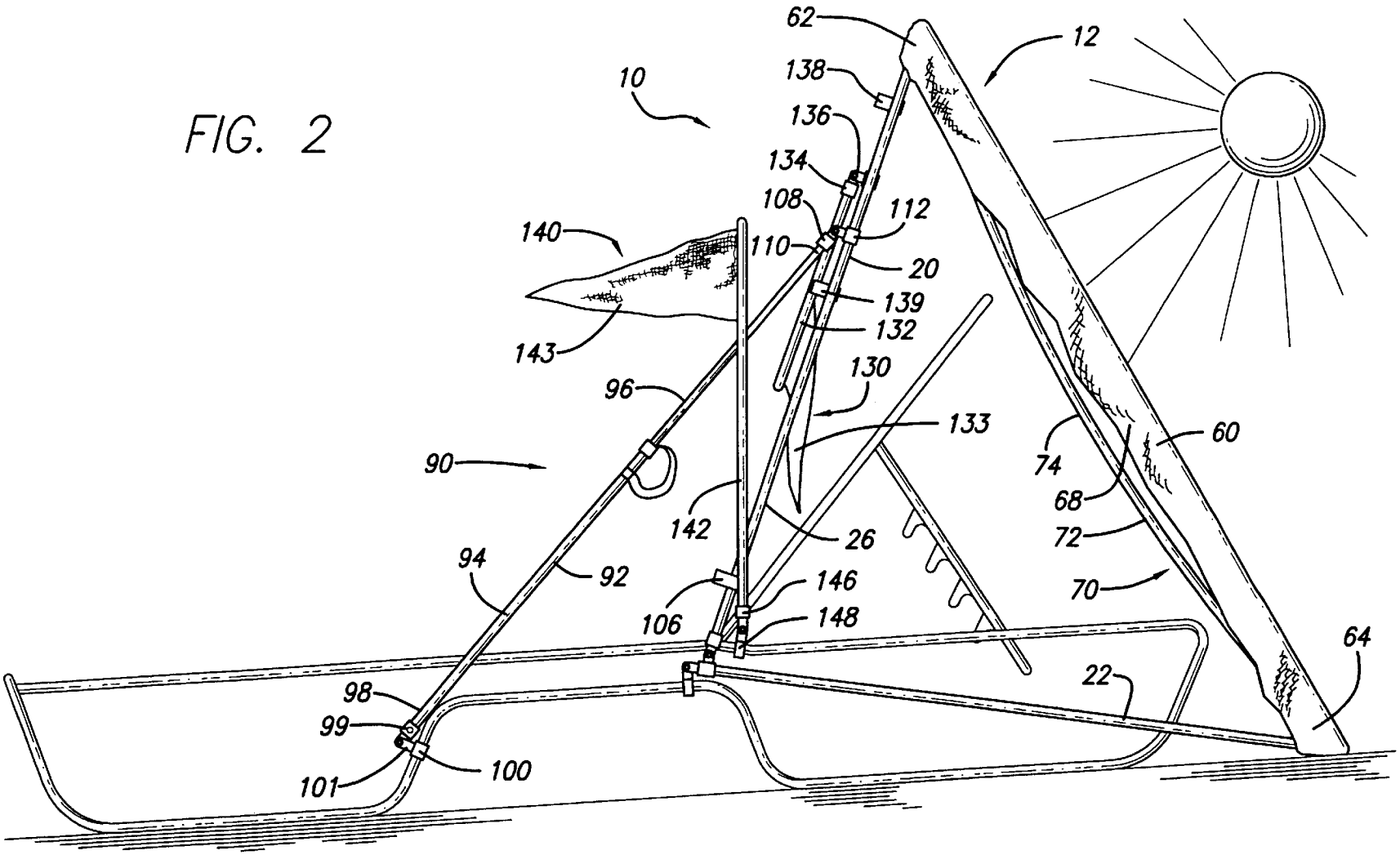
FIG. 2 is a side elevation of the sunshade assembly attached to the lounge chair, showing a flag in a raised position to indicate that the chair is occupied.
Figure 3:
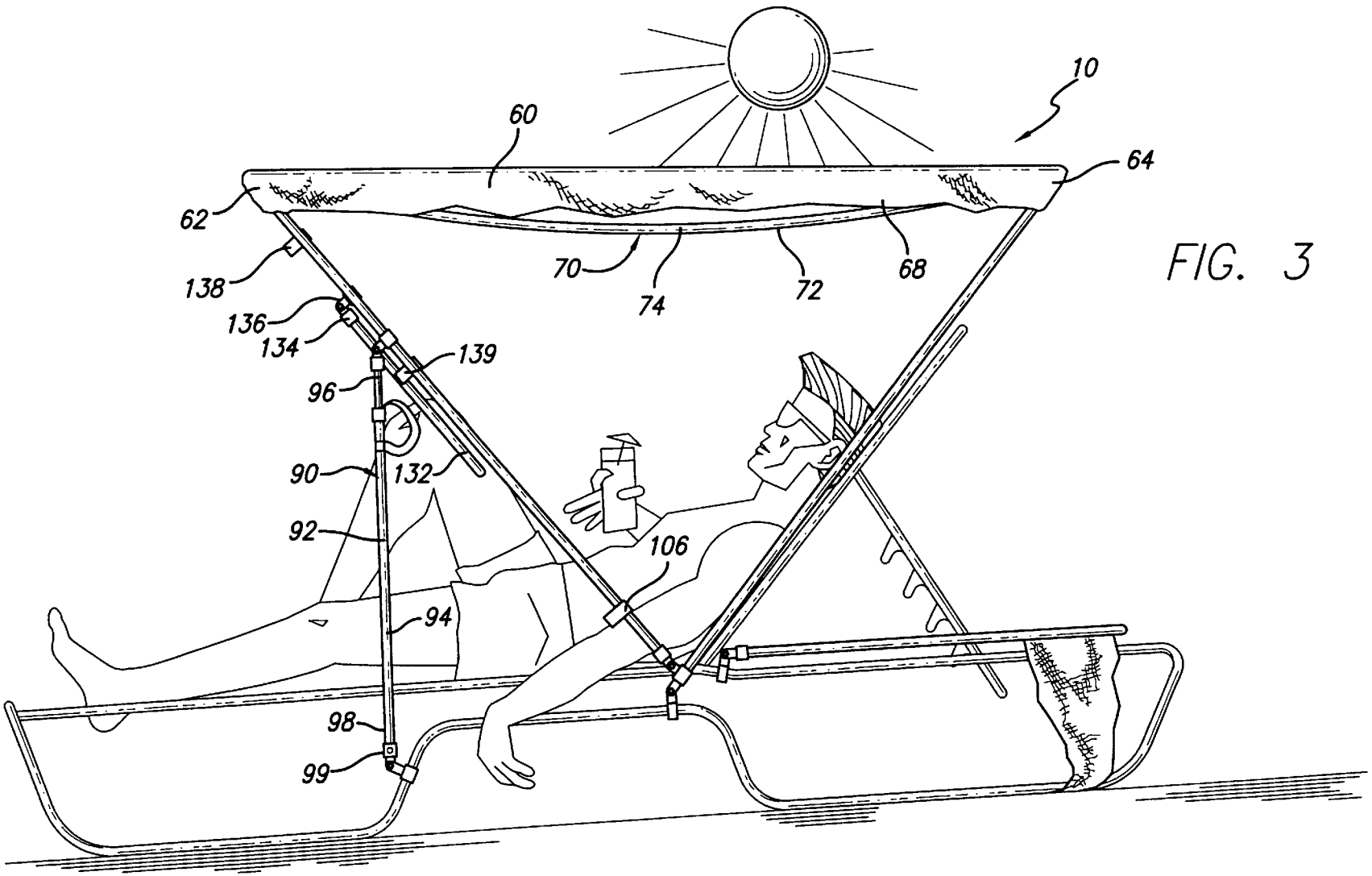
FIG. 3 is a side elevation of the sunshade assembly shown attached to the lounge chair, wherein the sunshade assembly is operably supported in another selected, adjusted position relative to the user and the lounge chair.
Figure 4:
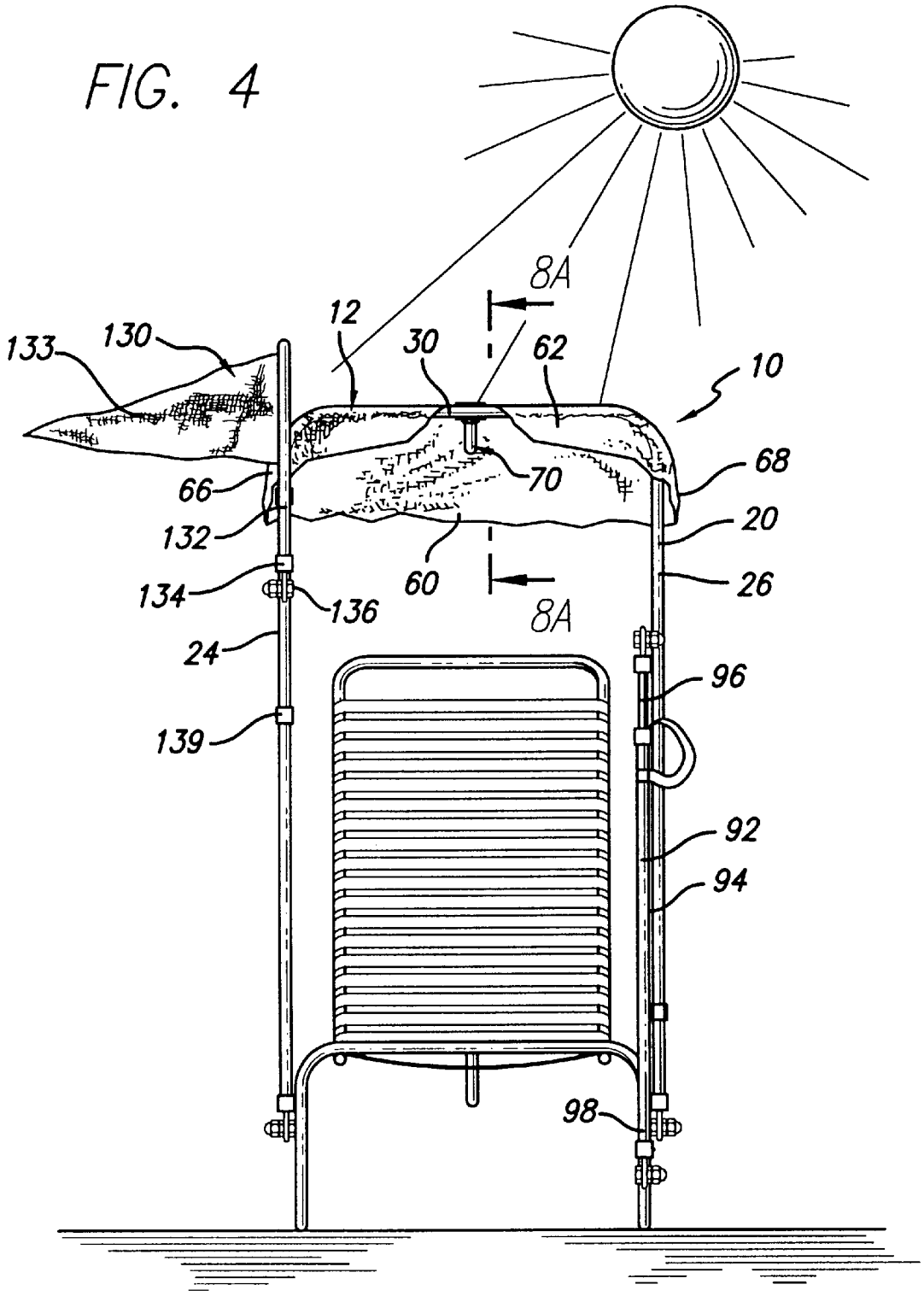
FIG. 4 is a front elevation of the sunshade assembly shown mounted to the lounge chair and in an operable, adjusted position.
Figure 7A:
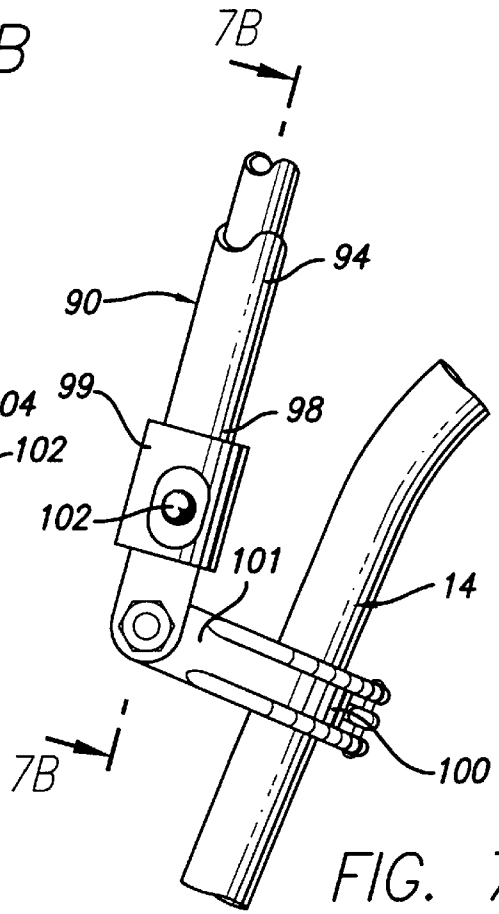
FIG. 7A is an isolated view taken from the area indicated as 7A in FIG. 1.
Figure 7B:
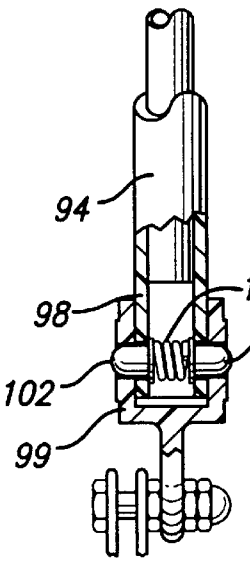
FIG. 7B is an isolated view taken along the plane of the line 7B—7B in FIG. 7A.

Brace means 90 are provided for selectively positioning and maintaining the opened canopy assembly 12 at adjusted positions throughout a range of movement from that shown in FIG. 1, wherein the cross arm 30 of the rear frame assembly is resting on the ground surface, to that shown in FIG. 3, wherein the canopy panel extends substantially parallel to the ground surface, providing full sun protection to the person seated in the lounge chair. In a preferred embodiment, the brace means 90 includes an elongate support arm 92 having a base section 94 and a telescoping section 96. A lower end 98 of the base section 94 is attached to the frame structure of the furniture 14. Specifically, an end eye fitting 99 is removably fitted to the lower end 98 of the section 94 of the support arm. The end eye fitting 99 pivotally attaches to a mounting flange 101 of clamp 100 which is fixedly attached to the frame structure of the furniture 14, as seen in FIG. 7A. The end portion 98 of the support arm 94 is fitted with a spring loaded button 102 which is urged outwardly through apertures in the hollow lower end 98 of the support arm by biasing element 104. Apertures are further provided within the sleeve of the end eye fitting 99, so that when the end of the support arm is fitted within the sleeve, the button is urged outwardly through the apertures to lock the support arm 92 to the end eye fitting 99. The end 98 of the support arm can be detached and separated from the frame of the furniture by depressing the spring loaded button and removing the end 98 from the end eye fitting 99. This allows the canopy assembly to be collapsed behind the furniture, as seen in FIG. 5. A clamp 106 is provided on the leg 26, near the lower end thereof, to releasably grasp and maintain the support arm in attachment with the forward frame member so that the end 98 of the support arm does not hang down and rest on the ground or interfere with structure on stacked chairs. An end eye fitting 108 is fixedly attached to an upper end 110 of the telescoping portion 96 of support arm 92 and pivotally attaches to a clevis fitting 112 on the leg 26 of the forward frame member 20 at a location between the distal end 28 and the cross arm 30, and preferably closer to the cross arm, as seen in FIGS. 1–5. The telescoping section 96 extends from the lower base section 94 of the support arm 92 to selectively adjust the overall length of the support arm. Upon extending the telescoping section, the change in length of the support arm causes pivotal movement of the canopy assembly 12 relative to the furniture article 14. In a first position, as seen in FIG. 3, the telescoping section is collapsed into the lower section of the support arm, defining a minimal length thereof, with the canopy assembly 12 maintained in the position shown in FIG. 3. To move the canopy assembly rearward, relative to the furniture article 12, so that the canopy assembly begins to pivot back behind the back rest, the telescoping section is extended from the base section of the support arm. Once located in the desired, adjusted position, the telescoping section is locked into place by lock means 120.

Figure 9:
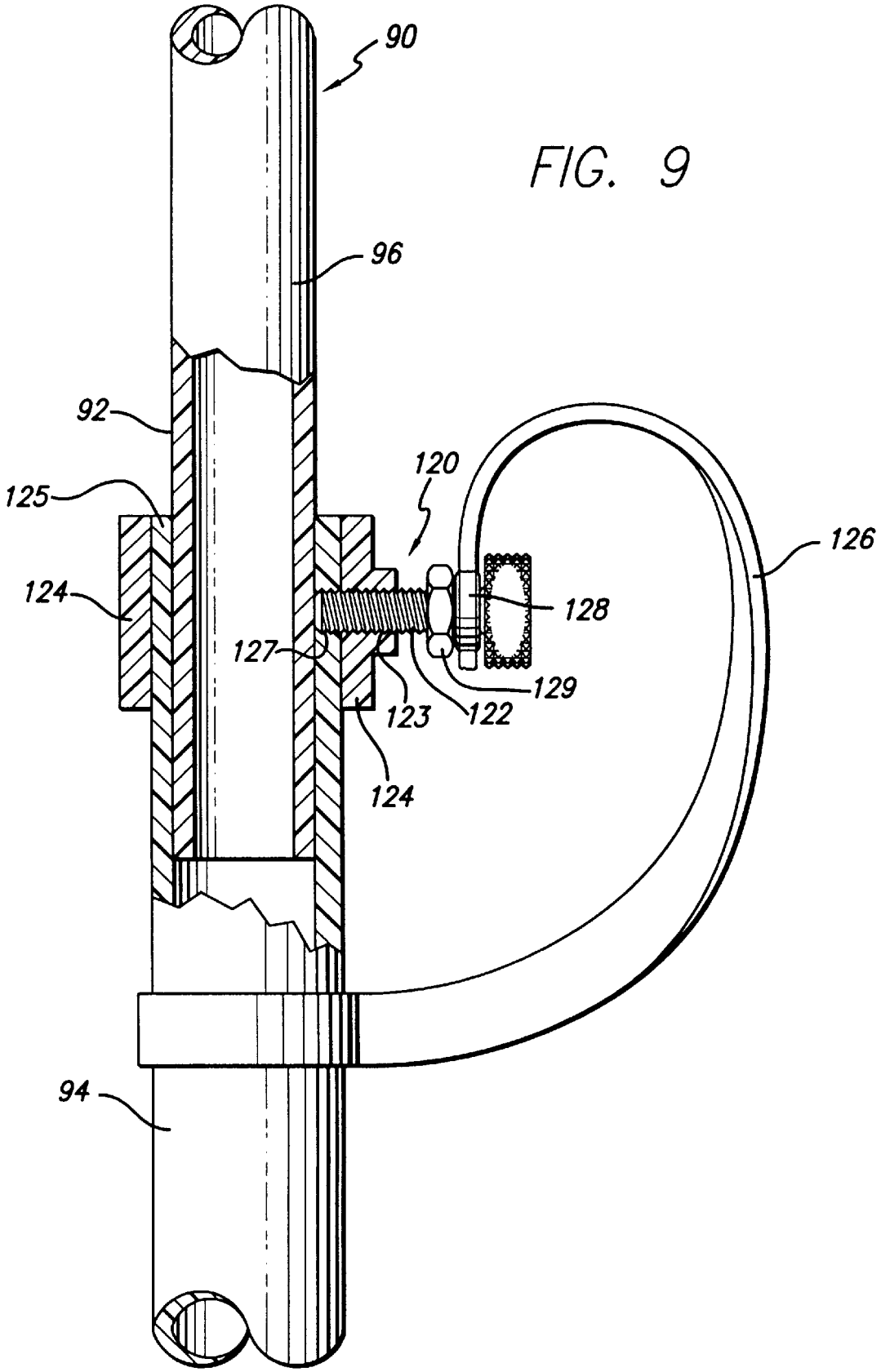
FIG. 9 is an isolated view, in partial section, taken from the area indicated as 9 in FIG. 1.

Referring to FIG. 9, the lock means 120 includes a set screw 122 which threadably advances through a threaded aperture 123 formed through a mounting collar 124. The mounting collar 124 is fitted to the top end 125 of the base section 94 of the support arm. The set screw 122 is further received through an aligned aperture 127 in the base section of the support arm so that, upon tightening, the set screw engages the exterior surface of the telescoping section 96. To move the telescoping section, and to thereby adjust the position of the canopy assembly 12, the set screw 122 is loosened so that it releases from engagement with the telescoping section. A tether strap 126 formed of a woven nylon or canvas strap is provided to prevent the set screw from being lost should it be removed from the mounting collar. The tether is attached to the base section of the support arm, by wrapping it tightly about the base section and stitching the tether strap 126 to itself. The opposite end of the tether strap is provided with a grommet 128 which receives the set screw 122 therethrough. A lock nut 129 is fitted to the set screw, on an opposite side of the tether strap preventing separation of the set screw from the end of the tether strap, while still permitting free rotation of the set screw relative to the grommet and tether strap.

The assembly of the present invention is further provided with one or more signal flags. In particular, a first flag 130 is provided for signalling for waiter service, such as cocktail service at the pool area of a hotel or resort. The flag 130 includes a pole 132 having a pennant or flag panel 133 fitted at an upper end. The lower end of the pole is pivotally attached to one of the legs 24 of the forward frame assembly 20, using an end eye 134 and clevis fitting 136, identical to those described above. A clamp 138 is further fitted to the leg 24 for releasably grasping the pole 132 of the flag 130 to maintain the flag in a raised position. The raised position of the flag 130 indicates that service is desired by the occupant seated in the furniture. Upon being served, the service personnel lowers the flag 130 to the position shown in FIG. 2. A second clamp 139 may be provided for releasably grasping the flag pole 132 to maintain it in the lowered position.

A second flag 140 is fitted to the frame structure of the furniture article 14 for indicating that the furniture article is occupied by a user. For example, if a person seated in the lounge chair (shown in the drawings) decides to go for a swim in the pool, or to otherwise temporarily leave the chair, the flag 140 is moved to the raised position, as shown in FIG. 2, so that others will not sit in the chair. The second flag 140 includes an elongate pole 142 with a pennant or like flag element 143 fitted to an upper end thereof. The lower end is pivotally mounted to the frame structure of the furniture article 14, as shown in FIG. 6A, using an end eye fitting 146 and clamp 148, identical to that described above in connection with the pivotal mounting of the canopy assembly to the furniture article 14. This permits movement of the flag 140 between the lowered position, as seen in FIG. 1, to the raised position, as shown in FIG. 2.

While the instant invention has been shown and described in accordance with a preferred and practical embodiment thereof, it is recognized that changes and modifications to the invention, as disclosed herein, may be made without departing from the spirit and scope of the following claims, as interpreted under the doctrine of equivalents.

What is claimed is:

1. A sunshade apparatus for use in conjunction with an article of outdoor furniture, said apparatus comprising:

a collapsible canopy assembly including:

a pair of generally U-shaped frame members including a forward frame member and a rear frame member, each of said frame members including opposite legs terminating at distal ends and a cross arm extending between said opposite legs;

a foldable material canopy panel having a forward edge zone attached to said cross arm of said forward frame member, and a rear edge zone attached to said cross arm of said rear frame member and opposite edge zones extending between said forward and rear edge zones on opposite sides of said canopy panel;

hinge means for pivotal attachment of said distal ends of said forward frame member to said distal ends of said rear frame member to allow pivotal movement of said forward and rear frame members relative to one another from a collapsed position, wherein said legs and cross arm of said forward frame member are parallel and adjacent to said legs and cross arm of said rear frame member, to a fully opened, operable position wherein said legs of said forward frame member are angularly positioned relative to said legs of said rear frame member and wherein said cross arm of said forward frame member is spaced from said cross arm of said rear frame member with said canopy panel pulled taut therebetween;

an elongate tensioning bar having saddle clamps fitted to opposite ends thereof, said saddle clamps being structured for removable attachment to said cross arm members of said forward and rear frame members, and said tensioning bar having a flexible memory and being structured and disposed to flex from a normally relaxed, straight position to a bowed position, upon exerting an external bending force thereto, to thereby allow removal and attachment of said saddle clamps to said cross arm members, said flexible memory urging said tensioning bar to return to said straight position upon release of said external bending force, thereby causing said saddle clamps to move outwardly, away from each other, and to apply an outward, separating force to said cross arms of said forward and rear frame members, thereby maintaining said frame members in said fully opened, operable position with said canopy panel pulled taut;

pivotal mounting means for adjustably attaching said canopy assembly to said article of outdoor furniture, said pivotal mounting means being structured and disposed for permitting movement of said canopy assembly relative to said article of outdoor furniture through a plurality of adjusted positions about a pivot axis; and brace means for supporting and maintaining said canopy assembly at each of said plurality of adjusted positions, to thereby permit selective control of a location of shade area created by said canopy panel.

2. The apparatus as recited in claim 1 wherein said brace means includes an elongate support arm having a first end and an opposite second end, said first end being attachable to said article of outdoor furniture in spaced relation to said pivotal mounting means, and said second end being attachable to one of said legs of said forward frame member between said distal end of said leg and said cross arm of said forward frame member, said support arm being selectively adjustable in length to vary a distance between said first end and said second end, and said canopy assembly being moved about said pivot axis upon changing the length of said support arm, and said support arm including lock means for locking said support arm at a selected adjusted length to thereby maintain said canopy assembly at a selected one of said plurality of adjusted positions.

3. The apparatus as recited in claim 2 wherein said support arm includes release means for releasing said first end from attachment to said article of outdoor furniture to thereby permit collapsing of said canopy assembly.

4. The apparatus as recited in claim 1 further including a first signal flag attached to said canopy assembly and being pivotally movable between a raised position and a lowered position.

5. The apparatus as recited in claim 4 further including means for releasably clamping said first signal flag in said raised and lowered positions.

6. The apparatus as recited in claim 1 further including means for indicating that said article of outdoor furniture is occupied.

7. The apparatus as recited in claim 6 wherein said means for indicating includes a signal flag including an elongate pole with a lower end adapted to be pivotally fitted to said article of outdoor furniture and an upper end zone having a flag extending therefrom, said elongate pole being pivotally movable from a lowered position to a raised position.

8. The apparatus as recited in claim 7 further including clamp means for releasably supporting said signal flag in said lowered and raised positions.

9. A sunshade apparatus for use in conjunction with an article of outdoor furniture, said apparatus comprising:

a collapsible canopy assembly including:

first and second frame members pivotally movable between a collapsed position and an opened, operable position;

a canopy panel formed of a foldable material, said canopy panel being fitted to and extending between said frame members, said canopy panel being pulled taut when said frame members are in said opened, operable position;

tensioning means for maintaining said frame members in said opened, operable position with said canopy panel pulled taut; and pivotal mounting means for attaching said canopy assembly to said article of furniture, said pivotal mounting means being structured and disposed for allowing selective movement of said canopy assembly throughout a plurality of adjusted positions relative to said article of outdoor furniture; and brace means for supporting and maintaining said canopy assembly at each of said plurality of adjusted positions, to thereby permit selective control of a location of shade area created by said canopy panel.

10. The apparatus as recited in claim 9 wherein said frame members of said canopy assembly are generally U-shaped and include a forward frame member and a rear frame member, and each of said frame members includes opposite legs terminating at distal ends and a cross arm extending between said opposite legs.

11. The apparatus as recited in claim 10 wherein said canopy assembly further includes hinge means for pivotal attachment of said distal ends of said forward frame member to said distal ends of said rear frame member to permit movement of said frame members relative to one another between said collapsed position, and said opened, operable position.

12. The apparatus as recited in claim 11 wherein said canopy panel includes a forward edge zone attached to said cross arm of said forward frame member, a rear edge zone attached to said cross arm of said rear frame member, and opposite edge zones extending between said forward and rear edge zones along opposite sides of said canopy panel.

13. The apparatus as recited in claim 12 wherein said tensioning means includes an elongate tensioning bar having means on opposite ends thereof for removable attachment to said cross arms of said forward and rear frame members, said tensioning bar having a flexible memory and being structured and disposed to flex from a normally relaxed, straight position to a bowed position, upon exerting an external bending force thereto, to thereby decrease a distance between said opposite ends and allowing attachment of said means on said opposite ends to said cross arms.

14. The apparatus as recited in claim 13 wherein said brace means includes an elongate support arm having a first end and an opposite second end, said first end being attachable to said article of outdoor furniture in spaced relation to said pivotal mounting means, and said second end being attachable to one of said legs of said forward frame member between said distal end of said leg and said cross arm of said forward frame member, said support arm being selectively adjustable in length to vary a distance between said first end and said second end, and said canopy assembly being moved about said pivotal axis upon changing the length of said support arm, and said support arm including lock means for locking said support arm at a selected adjusted length to thereby maintain said canopy assembly at a selected one of said plurality of adjusted positions.

15. The apparatus as recited in claim 14 wherein said support arm includes release means for releasing said first end from attachment to said article of outdoor furniture to thereby permit collapsing of said canopy assembly.

16. The apparatus as recited in claim 9 further including a first signal flag attached to said canopy assembly and being pivotally movable between a raised position and a lowered position.

17. The apparatus as recited in claim 16 further including means for releasably clamping said first signal flag in said raised and lowered positions.

18. The apparatus as recited in claim 9 further including means for indicating that said article of outdoor furniture is occupied.

19. The apparatus as recited in claim 18 wherein said means for indicating includes a signal flag including an elongate pole with a lower end adapted to be pivotally fitted to said article of outdoor furniture and an upper end zone having a flag extending therefrom, said elongate pole being pivotally movable from a lowered position to a raised position.

* * * * *